US010215473B2

(12) United States Patent
Ding et al.

(10) Patent No.: US 10,215,473 B2
(45) Date of Patent: Feb. 26, 2019

(54) REFRIGERATOR

(71) Applicant: BSH HAUSGERAETE GMBH, Munich (DE)

(72) Inventors: Yuan Ding, Wuxi (CN); Jicong Song, Nanjing (CN); Changliang Zhao, Nanjing (CN)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/327,090

(22) PCT Filed: Jul. 16, 2015

(86) PCT No.: PCT/IB2015/055372

§ 371 (c)(1),
(2) Date: Jan. 18, 2017

(87) PCT Pub. No.: WO2016/009373

PCT Pub. Date: Jan. 21, 2016

(65) Prior Publication Data

US 2017/0159994 A1 Jun. 8, 2017

(30) Foreign Application Priority Data

Jul. 18, 2014 (CN) ..... 2014 2 0404180 U

(51) Int. Cl.
*F25D 23/02* (2006.01)
*F25D 29/00* (2006.01)

(52) U.S. Cl.
CPC ..... *F25D 23/028* (2013.01); *F25D 23/02* (2013.01); *F25D 29/005* (2013.01); *F25D 2400/361* (2013.01)

(58) Field of Classification Search
CPC ..... F25D 23/028; F25D 29/005; F25D 23/02; F25D 2400/361; F25D 23/04;
(Continued)

(56) References Cited

U.S. PATENT DOCUMENTS 4,922,576 A * 5/1990 Weidner ..... E05B 1/0015 16/413
4,966,004 A * 10/1990 Midlang ..... F25D 29/005 200/302.2

(Continued)

FOREIGN PATENT DOCUMENTS

| | | | |
|---|---|---|---|
| DE | 102012200812 | A1 | 7/2013 |
| JP | 2004044980 | A | 2/2004 |
| JP | 2013178054 | A | 9/2013 |
| JP | 2013178055 | * | 9/2013 |

OTHER PUBLICATIONS

English translation of JP2013178055, dated Sep. 9, 2013.*

*Primary Examiner* — Hiwot E Tefera
(74) *Attorney, Agent, or Firm* — Laurence A. Greenberg; Werner H. Stemer; Ralph E. Locher

(57) ABSTRACT

A refrigerator includes a door having a user interface electrical module, a first receiving space that receives the user interface electrical module, a second receiving space open towards a side of the door, and a handle member detachably received in the second receiving space. The handle member closes the first receiving space, and when the handle member is detached, and the user interface electrical module is accessible through the second receiving space. The door further includes a sealing member having a sealing portion located between the handle member and at least one boundary wall of the second receiving space.

14 Claims, 4 Drawing Sheets

(58) Field of Classification Search
CPC .. F25D 2400/00; F25D 2400/36; F25D 23/00; F25D 29/00
USPC ..... 312/401, 405, 405.1, 321.5
See application file for complete search history.

(56) References Cited

U.S. PATENT DOCUMENTS

| | | | | |
|---|---|---|---|---|
| 8,485,617 | B2 * | 7/2013 | Park | F25D 23/028 312/405.1 |
| 8,752,919 | B2 * | 6/2014 | Park | F25D 23/028 312/405.1 |
| 9,074,806 | B2 * | 7/2015 | Cheon | F25D 29/00 |
| 9,459,041 | B2 * | 10/2016 | Park | F25D 23/028 |
| 9,890,992 | B2 * | 2/2018 | Becke | F25D 27/00 |
| 9,976,795 | B2 * | 5/2018 | Becke | F25D 23/028 |
| 10,018,404 | B2 * | 7/2018 | Becke | F25D 23/028 |
| 10,072,886 | B2 * | 9/2018 | Koo | F25D 17/04 |
| 2010/0107679 | A1 * | 5/2010 | Park | F25D 23/028 62/441 |
| 2011/0273071 | A1 * | 11/2011 | Kim | F25D 23/028 312/405 |
| 2013/0099650 | A1 * | 4/2013 | Lee | F25D 23/028 312/404 |
| 2013/0285528 | A1 * | 10/2013 | Park | F25D 23/028 312/404 |
| 2015/0052920 | A1 * | 2/2015 | Park | F25D 29/005 62/126 |
| 2017/0115049 | A1 * | 4/2017 | Ding | F25D 23/028 |
| 2017/0138658 | A1 * | 5/2017 | Ding | F25D 23/028 |

* cited by examiner

REFRIGERATOR

BACKGROUND

Technical Field

The present invention relates to a refrigerator, and more particularly to a household refrigerator with a door.

Related Art

JP 2013-178054 A discloses a refrigerator door, including a door body having a heat insulating material. A user interface apparatus is disposed in an intermediate region, viewed from a longitudinal direction, of the door body, and located behind a glass plate of the door body. A step member making a front surface concaved is formed on a side cover of a right end portion of the door body. The step member closes and receives a receiving compartment of the user interface apparatus. A handle member protruding towards the right side is installed on an installation surface of a side facing the step member by using a screw. A handle groove extending along the entire height of the door is formed between the handle member and the step member. A front surface of the handle portion is covered by a protective cover clamped between a front end of the handle portion and the step member. The protective cover is formed by a transparent resin formed part.

SUMMARY

An object of the present invention is to overcome at least one technical problem in the prior art, so as to provide an improved refrigerator.

The object can be achieved through features in the independent claim. Preferable embodiments of the present invention are subject matters of the accompanying drawings, the specification and the dependent claims.

An aspect of the present invention relates to a refrigerator. The refrigerator includes a door, characterized in that, the door includes a user interface electrical module; a first receiving space that receives the user interface electrical module; a second receiving space open towards a side of the door; and a handle member detachably received in the second receiving space, wherein the handle member closes the first receiving space, and when the handle member is detached, the user interface electrical module is accessible via the second receiving space; wherein the door further includes a seal, and the seal includes a sealing portion located between the handle member and at least one boundary wall of the second receiving space.

So, possibility can be reduced that water vapor, dust and the like enter into the first receiving space through the second receiving space to reduce the service life of electric parts.

The present invention is applicable to refrigerators with various different structures, for example, the present invention is applicable to a side-by-side combination refrigerator having a first storage compartment and a second storage compartment disposed side by side, is applicable to a refrigerator having a first storage compartment and a second storage compartment disposed up and down, and may have a refrigerator where a pair of doors close the same storage compartment.

A storage compartment of a refrigerator may be used for storing food and/or wine, for example, the refrigerator may have at least one storage compartment purely for storing wine.

The door may be a rotatable door pivotally connected to the main body of the refrigerator, and may also be a drawer-type door drawably connected to the main body.

The door may close one or more storage compartments of the refrigerator, and may also close a part of one or more storage compartments.

In one possible embodiment, the second receiving space may be open towards a longitudinal side (e.g., left side or right side) of the door. In one alternative embodiment, the second receiving space may be open towards a horizontal side (e.g., top side or bottom side) of the door.

The user interface electrical module may include an input unit for receiving a user input instruction and/or an output unit displaying information for a user.

The user interface electrical module may be completely located in a first receiving space, or one part is located in the first receiving space, and the other part is located outside the first receiving space.

The expression "the handle member is detachable" means detaching the handle member from the door by using a tool or not using a tool without damaging the door, where the handle member can be installed to the door once again.

When the handle member is detached, the user interface module may be taken out of the first receiving space or placed into the first receiving space.

In one embodiment, the seal may be only formed by sealing portions. In another embodiment, the seal further includes, for example, other parts for installation.

Boundary walls of the second receiving space are walls defining and directly facing the second receiving space. The sealing portion may be located at the handle member and one or more boundary walls of the second receiving space. The sealing portion may further extend only along part of the length/height/thickness of one or more boundary walls.

Other individual features or those combined with other features to be regarded as characteristics of the present invention are set forth in the following appended claims.

In one possible embodiment, the handle member includes a first end close to the first receiving space and a second end away from the first receiving space, and the seal is disposed between the first end and the at least one boundary wall. Thus, the second end of the handle member may not be pressed towards the boundary wall of the second receiving space due to the seal. For example, it is possible that a gap is formed between the second end of the handle member and a front boundary wall of the second receiving space. This helps to reduce the probability that the front panel and the user interface electrical module are in poor contact possibly caused by a force applied to the front panel by the grip portion when the grip portion is gripped to pull the door forward. Preferably, the gap is not less than 0.2 mm and not greater than 1 mm, especially between 0.2 mm and 0.6 mm. Therefore, a front surface of the grip portion is disposed adjacent to the front panel. In this way, not only can the possibility that foreign matters enter into the gap be reduced, but also the possibility that a force is applied to the front panel due to deformation of the handle member is reduced.

In one possible embodiment, the door includes a front panel covering the user interface electrical module and the handle member, the front panel forms front boundaries of the first receiving space and the second receiving space, and the sealing portion is disposed between a front surface of the handle member and the front panel.

In one possible embodiment, the sealing portion extends on the entire height of the handle member.

In one possible embodiment, the sealing portion is annular, and disposed all around the handle member.

In one possible embodiment, the seal and the handle member are assembled to the door by forming a pre-assembled unit. In other words the seal and the handle member form a pre-assembled unit. This particularly helps to assemble the seal to the door. For example, before the handle member is fixed to the door, the seal may be positioned/fixed to the handle member through mechanical structural/chemical connection.

In one possible embodiment, the seal is sheathed on the handle member.

In one possible embodiment, the handle member includes a covering portion for closing the first receiving space, and the sealing portion is located between the covering portion and the at least one boundary wall.

In one possible embodiment, the seal includes a base portion attached to the covering portion and disposed facing one side of the first receiving space, and the sealing portion extends outwards from an edge of the base portion. Preferably, the base portion has a shape adapted to the covering portion.

In one possible embodiment, the second receiving space further includes a concave portion forward and open towards a side of the door, a handle groove located within the second receiving space is accessible to a user through the concave portion, and the first receiving space and the second receiving space are located in the same housing member. By integrating the first receiving space, the handle groove and the concave portion in the user interface housing, the handle groove and the concave portion are formed without an additional member, which not only helps to simplify construction of the door, but also helps to form an integrated user operation center.

The structure and other invention objectives as well as beneficial effects of the present invention will be more comprehensible with reference to the accompanying drawings and the description about the preferable embodiments.

BRIEF DESCRIPTION OF THE DRAWINGS

As a part of the specification and for facilitating further comprehension of the present invention, the following accompanying drawings illustrate specific implementation manners of the present invention, and describe the principle of the present invention together with the specification.

DETAILED DESCRIPTION

Figure 1:
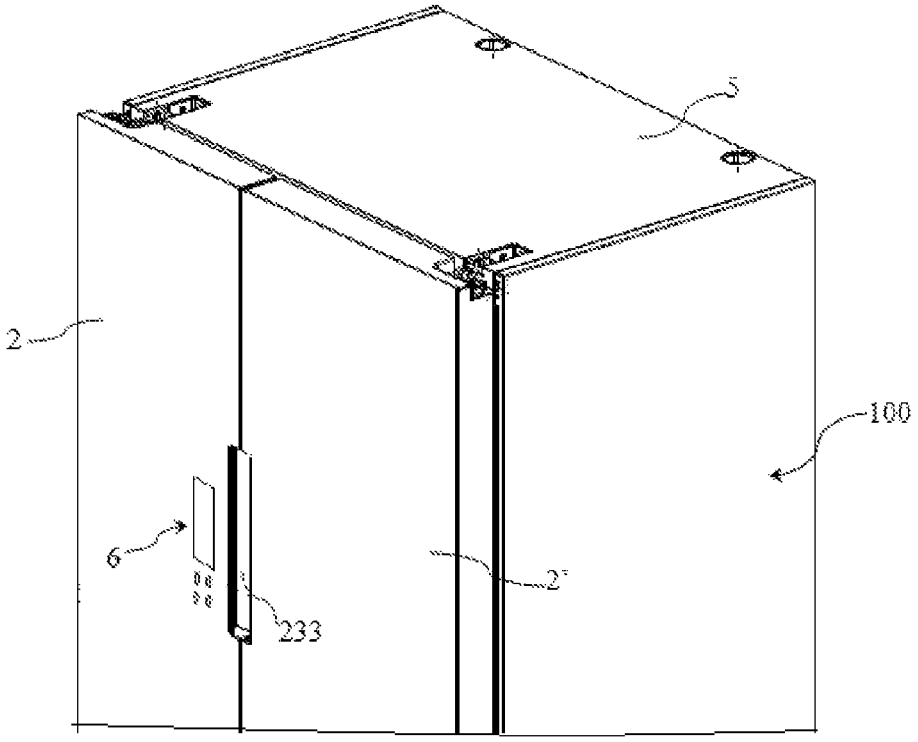
FIG. 1 is a schematic partial perspective view of a refrigerator according to a preferable embodiment of the present invention.

FIG. 1 is a schematic perspective view of a refrigerator 100 according to a preferable embodiment of the present invention. As shown in FIG. 1, the refrigerator 100 includes a main body 5 having a first storage compartment (not shown) and a second storage compartment (not shown) disposed side by side. The refrigerator 100 further includes a pair of French doors 2, 2' connected to the main body 5 to close a corresponding storage compartments, respectively.

Figure 2:
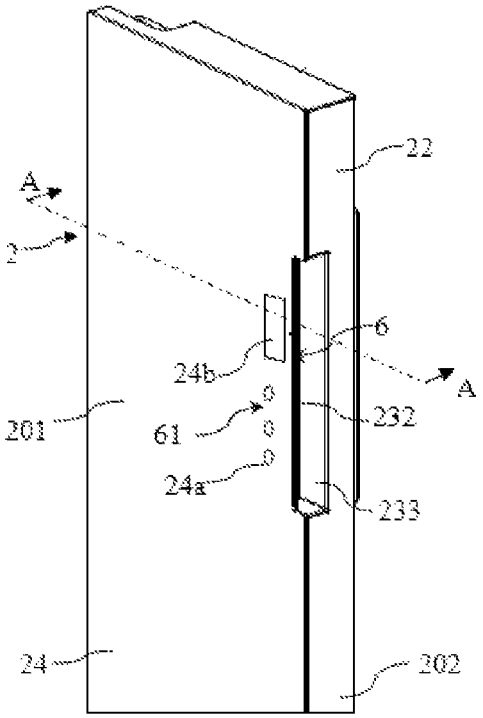
FIG. 2 is a schematic partial perspective view of a door according to a preferable embodiment of the present invention.
Figure 3:
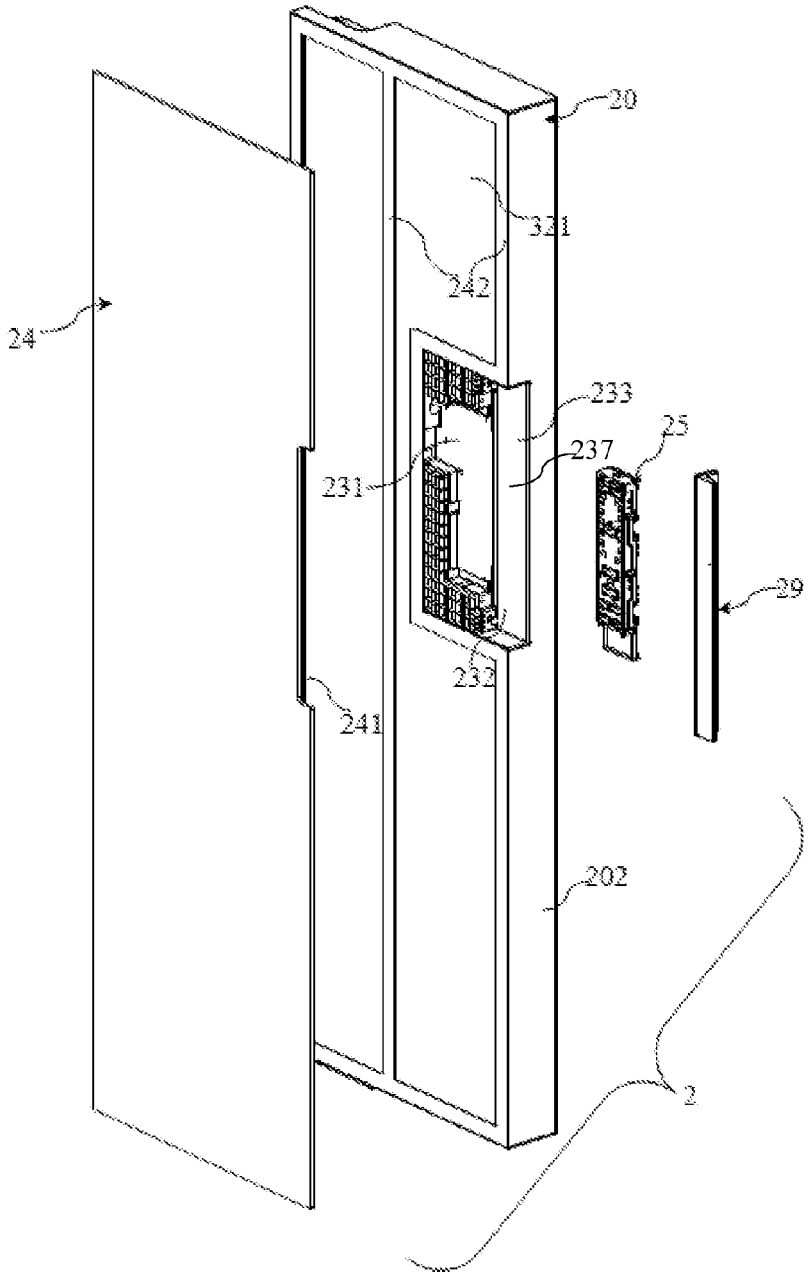
FIG. 3 is a partial exploded view of a door according to a preferable embodiment of the present invention.
Figure 4:
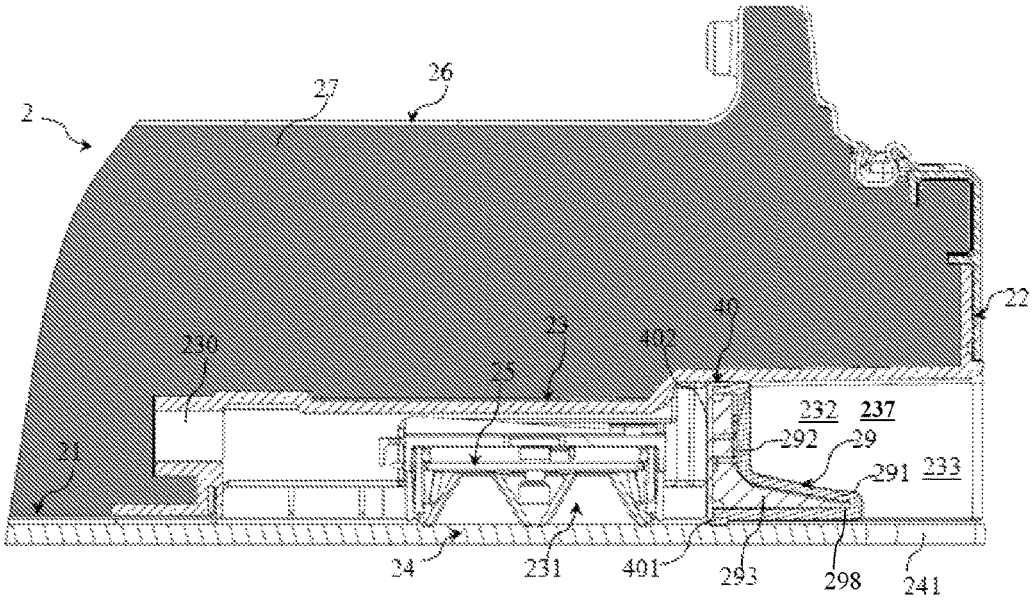
FIG. 4 is a partial sectional view along the A-A line in FIG. 2.

Referring to FIG. 2 to FIG. 4 in combination with FIG. 1, the door 2 has an integrated operation center 6. The operation center 6 includes a user interface 61 and a handle groove 232 integrated in the operation center 6. When opening or closing the door 2, the user's fingers can stretch into the handle groove 232. The operation center 6 further includes a concave portion 233 concaved backwards, and the user's fingers enter into the handle groove 232 through the concave portion 233.

The user interface 61 is configured to receive inputs from users and to output information to the users, and such information may include, for example, setting information about the refrigerator 100 and/or information of food stored in the refrigerator 100, etc. The user interface 61 includes a plurality of touch areas 24*a* and a display area 24*b* on a front panel 24. The touch areas 24*a* may, as shown in FIG. 2, be separated from the display area 24*b*, and may also be located in the display area 24*b*.

The user interface 61 includes a user interface electrical module 25 located behind the touch regions 24*a* and the display region 24*b*. The user interface electrical module 25 may include a light source, and when the light source is turned on, light can transmit through the display area 24*b*.

As shown in FIG. 7, the concave portion 233 is open towards a front surface 201 and a side surface 202 of the door 2. The concave portion 233, the handle groove 232 and the user interface electrical module 25 are arranged side by side in a depth direction of the handle groove 232 (which is also a transverse direction of the door 2 in this embodiment). Viewed from the front, visual elements of the user interface 61, such as the touch areas 24*a* and the display area 24*b* through which light may transmit, the handle groove 232 and the concave portion 233 are disposed side by side in sequence in a transverse direction of the door 2.

The door 2 includes a door body 20 having a heat insulating material 27, and the front panel 24 covers the front of the door body 20. The front panel 24 has an edge notch 241 located in front of the concave portion 233, so as to expose the concave portion 233 to the user.

The front panel 24 may be made from glass or resins like glass. The front panel 24 may be adhered to the door body 20 through an adhering apparatus 242 disposed at least around a front edge of the door body 20.

The door body 20 includes a user interface housing 23. The user interface housing 23 is constructed independently from a front wall 21 and a side wall 22 of the door body and then connected to them. The user interface housing 23, the front wall 21, the side wall 22 and a door liner 26 are connected fixedly to a heat insulating material 27 located between the front wall 21 and the door liner 26.

Referring to FIG. 4, the user interface housing 23 has a recess portion concaved backwards, to form, on the door 2, a first receiving space 231 for receiving the user interface electrical module 25 and a second receiving space 237 disposed side by side with the first receiving space 231. The second receiving space 237 is open towards a side of the door 2.

The user interface housing 23 has a through-line hole 230, and a cable can enter into the first receiving space 231 via the through-line hole 230 to be connected with the user interface electrical module 25.

In this embodiment, the first receiving space 231 and the second receiving space 237 are located between the front panel 24 and the user interface housing 23. Boundary walls of the first receiving space 231 and the second receiving space 237 are formed by the user interface housing 23 and the front panel 24, wherein the front panel 24 forms front boundary walls of the first receiving space 231 and the second receiving space 237. The user interface housing 23 forms rear boundary walls, upper boundary walls and lower boundary walls of the first receiving space 231 and the second receiving space 237.

The user interface electrical module 25 is attached to the front panel 25, to receive an instruction input by the user by touching the front panel 24.

The door 2 includes a handle member 29 detachably received in the second receiving space 237. The door 2 may include a user interface electrical module 25 for detachably fixing the handle member 29 to the user interface housing 23 by a screw (not shown), such that it is possible to check the user interface electrical module 25 when necessary.

The handle member 29 closes an inlet of the first receiving space 231 which inlet is open towards the second receiving space 237. When the handle member 29 is fixed to the door 2, the inlet of the first receiving space 231 is closed, and the user is not able to get access to the first receiving space 231. When the handle member 29 is removed from the door 2, the user interface electrical module 25 is accessible via the second receiving space 237. For example, the user interface electrical module 25 can be removed from the first receiving space 231, or the user interface electrical module 25 may be placed into the first receiving space 231 via the second receiving space 237.

The handle member 29 includes a grip portion 291 in the second receiving space 237. The handle groove 232 is located behind the grip portion 291.

After the user's fingers stretch into the handle groove 232, the fingers in the handle groove 232 can hold the grip portion 291, to open the door 2. For example, some fingers of the user press on a rear surface of the grip portion 291, and another finger (e.g., thumb) presses on the front panel 24 in front of the grip portion 291, so as to apply a force to open the door 2.

The handle member 29 includes a covering portion 292 for closing the open side of the first receiving space 231. The grip portion 291 is connected to a front side of the covering portion 292.

The handle groove 232 and the first receiving space 231 are divided by the covering portion 292. In the second receiving space 237, the handle groove 232 is located behind the grip portion 291 and the latter defines a side boundary of the covering portion 292, and the concave portion 233 in communication with the handle groove 232 is located behind the edge cutout 241 and thus it is exposed to the front of the door 2.

A side of the covering portion 292, which side is faced towards the handle groove 232, may be at least substantially perpendicular to a front panel 24 located in front of the user interface electrical module 25 and the handle member 29 and accordingly at least substantially perpendicular to the front surface 201 of the door 2. In this embodiment, the covering portion 292 is shape substantially like a board.

The grip portion 291 has a front surface which is at least substantially parallel to the front panel 24. Thus, the handle member 29 has a substantially L-shaped cross section.

Figure 5:
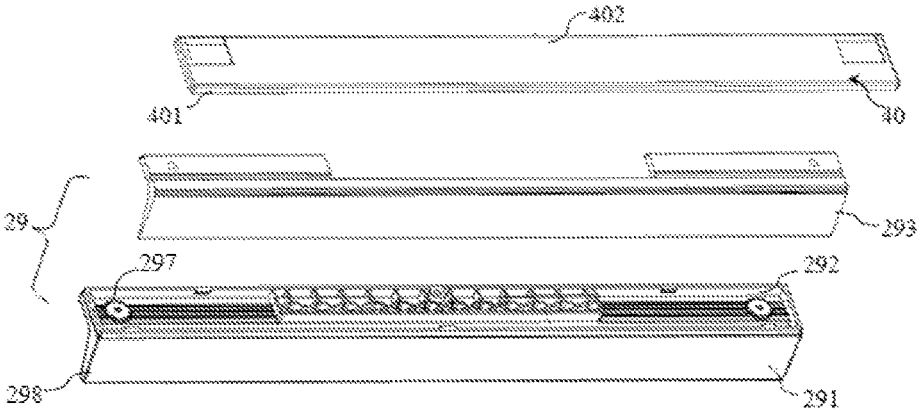
FIG. 5 is a schematic exploded view of a handle member and a seal according to a preferable embodiment of the present invention.

As shown in FIG. 4 and FIG. 5, the door 2 includes a sealing member 40, and the sealing member 40 includes a sealing portion 401 located between the handle member 29 and at least one boundary wall of the second receiving space 237. In this way, a possibility that water vapor, dust and the like enter into the first receiving space 231 may be reduced.

In this embodiment, the sealing portion 401 forms a close loop, and disposed all around the handle member 29, and thus the sealing portion 401 is extending along the entire length and width of the handle member 29.

Specifically, the sealing portion 401 is disposed between front, rear, upper and lower boundary walls of the second receiving space 237 and the handle member 29. For example, between a front surface of the handle member 29 facing the front panel 24 and the front panel 24, it is provided with the sealing portion 401.

The handle member 29 includes a first end 297 close to the first receiving space 231 and a second end 298 away from the first receiving space 231, and the sealing portion 401 is disposed along the first end 297. The second end 298 of the handle member 29 is adjacent to the concave portion 233. In this embodiment, the first end 297 of the handle member 29 is formed by the covering portion 292, that is, the sealing portion 401 is located between the covering portion 292 and the boundary wall of the second receiving space 237.

The handle member 29 has a portion which is located between the sealing portion 401 and the second end 298 in a transverse direction, and a gap is formed between this portion of the handle member 29 and the front panel 24 in a fore-and-aft direction. The gap is preferably not less than 0.2 mm and not greater than 1 mm, especially between 0.2 mm and 0.6 mm.

Specifically, the front surface of the grip portion 291 is adjacent to the front panel 24 but is spaced apart from the rear surface of the front panel 24 by a tiny gap. For example, the grip portion 291 is adjacent to the front panel 24 with a gap between the grip portion 291 and the front panel 24 in the fore-and-aft direction not less than 0.2 mm but not greater than 1 mm. Preferably, the gap between the front surface of the grip portion 291 and the front panel 24 is between 0.2 mm and 0.6 mm, for example, the gap is 0.6 mm.

The handle member 29 may further include a metal reinforcement member 293, especially for strengthening of the grip portion 291. The reinforcement member 293 may be extending along almost an entire length of the grip portion 291, which is advantageous to prevent a technical problem that the user interface electrical module 25 and the front panel 24 are in poor contact caused by a force applied to the front panel 24 by transverse deformation of the grip portion 291 in a process of opening the door.

In this embodiment, the sealing member 40 includes a base portion 402 attached to one side of the covering portion 292 which side is faced to the first receiving space 231. The base portion 402 has a shape adapted to the covering portion 292, and thus is substantially sheet-like in this embodiment. The sealing portion 401 is extending outwards from an edge of the base portion 402, and the sealing member 40 can be sheathed on the handle member 29. In this way, the sealing member 40 and the handle member 29 may form a pre-assembled unit and then be assembled to the door 2.

In this embodiment, the user interface electrical module 25 is provided with a light source (not shown) for illuminating the handle groove 232 and the concave portion 233. Therefore, the handle member 29 and the seal 40 are provided thereon with corresponding holes/openings (not labeled) to allow light to enter into the handle groove 232 and the concave portion 233.

Various embodiments of single parts described in combination with FIG. 1 to FIG. 5 can be combined in any given manner, to implement advantages of the present invention. In addition, the present invention is not limited to the illustrated embodiments, and generally, other means other than the illustrated means may also be used, as long as the means may also achieve the same effect.

What is claimed is:

1. A refrigerator, comprising a door, said door including:

a side of said door;

a user interface electrical module;

a first receiving space receiving said user interface electrical module;

a second receiving space being open towards said side of said door and having at least one boundary wall;

a handle member detachably received in said second receiving space, said handle member closing said first receiving space, said handle member having longitudinal sides opposite one another and longitudinal end sides opposite one another and extending between said longitudinal sides;

said user interface electrical module being accessible through said second receiving space upon removing said handle member; and a sealing member having a sealing portion sealing said longitudinal sides and said longitudinal end sides to said at least one boundary wall of said second receiving space.

2. The refrigerator according to claim 1, wherein said handle member includes a first end facing towards said first receiving space and a second end facing away from said first receiving space, said sealing member being disposed between said first end of said handle member and said at least one boundary wall.

3. The refrigerator according to claim 2, wherein:

said door includes a front panel covering said user interface electrical module and said handle member;

said handle member has a portion located between said sealing member and said second end of said handle member in a transverse direction; and said front panel and said portion of said handle member form a gap therebetween.

4. The refrigerator according to claim 3, wherein said gap is not less than 0.2 mm and not greater than 1 mm.

5. The refrigerator according to claim 3, wherein said gap is between 0.2 mm and 0.6 mm.

6. The refrigerator according to claim 1, wherein:

said door includes a front panel covering said user interface electrical module and said handle member;

said front panel defines front boundaries of said first receiving space and said second receiving space;

said handle member has a front surface; and said sealing portion is disposed between said front surface of said handle member and said front panel.

7. The refrigerator according to claim 1, wherein said handle member has a height, and said sealing portion extends entirely over said height of said handle member.

8. The refrigerator according to claim 1, wherein said sealing portion forms a closed loop surrounding said handle member.

9. The refrigerator according to claim 1, wherein said sealing member and said handle member are mounted to said door as a pre-assembled unit, and said sealing member is sheathed on said handle member.

10. The refrigerator according to claim 1, wherein said handle member includes a covering portion for closing said first receiving space, and said sealing portion is located between said covering portion and said at least one boundary wall.

11. The refrigerator according to claim 1, which further comprises:

a housing member, said first receiving space and said second receiving space being located together in said housing member;

said second receiving space includes a concave portion being open in a forward direction and being open towards said side of said door; and said second receiving space includes a handle groove within said second receiving space being accessible to a user through said concave portion.

12. The refrigerator according to claim 1, wherein said sealing portion defines a closed loop and said at least one boundary wall is four boundary walls corresponding to said longitudinal sides and said longitudinal end sides.

13. A refrigerator, comprising a door, said door including:

a side of said door;

a user interface electrical module;

a first receiving space receiving said user interface electrical module;

a second receiving space being open towards said side of said door and having at least one boundary wall;

a handle member detachably received in said second receiving space, said handle member closing said first receiving space;

said user interface electrical module being accessible through said second receiving space upon removing said handle member; and a sealing member having a sealing portion located between said handle member and said at least one boundary wall of said second receiving space;

said handle member including a covering portion for closing said first receiving space, said covering portion having a side facing towards said first receiving space and said sealing portion being located between said covering portion and said at least one boundary wall;

said sealing member having a base portion attached to said side of said covering portion, said base portion having an edge; and said sealing portion extending outwards from said edge of said base portion.

14. The refrigerator according to claim 13, wherein said base portion has a shape adapted to said covering portion.

* * * * *